United States Patent [19]

Vogt

[11] Patent Number: 4,490,103

[45] Date of Patent: Dec. 25, 1984

[54] PRESS WITH EASILY EXCHANGEABLE PROOF PLATES

[75] Inventor: Willy Vogt, Zurich, Switzerland

[73] Assignee: Bucher-Guyer AG, Zurich, Switzerland

[21] Appl. No.: 74,974

[22] Filed: Sep. 13, 1979

[30] Foreign Application Priority Data

Sep. 25, 1978 [DE] Fed. Rep. of Germany ..... 2841684

[51] Int. Cl.[3] ..... B28B 3/02; B28B 7/00

[52] U.S. Cl. ..... 425/193; 425/344; 425/352; 425/415; 425/423

[58] Field of Search ..... 425/193, 195, 344, 352, 425/406, 415, 423, 25, 17

[56] References Cited

U.S. PATENT DOCUMENTS

| | | | |
|---|---|---|---|
| 532,186 | 1/1895 | Rolfe et al. | 425/193 |
| 630,397 | 8/1899 | Niedringhaus | 425/344 X |
| 770,360 | 9/1904 | Fisher | 425/415 |
| 1,232,297 | 7/1917 | Hambuechen | 425/415 X |
| 1,254,183 | 1/1918 | Williams | 425/406 X |
| 1,321,160 | 11/1919 | Stommel | 425/415 X |
| 1,322,960 | 11/1919 | Schumacher | 425/415 X |
| 1,466,730 | 9/1923 | Sanford | 425/406 X |
| 1,880,874 | 10/1932 | Derry | 425/406 X |
| 1,952,951 | 3/1934 | Stehley | 425/406 X |
| 2,358,765 | 9/1944 | Stadlin | 425/415 |
| 2,557,014 | 6/1951 | Sklarsky | 425/406 X |
| 3,067,457 | 12/1962 | Dennis et al. | 425/17 X |
| 4,035,118 | 7/1977 | MacMillan | 425/25 |

*Primary Examiner*—Jan Silbaugh
*Assistant Examiner*—Hubert C. Lorin
*Attorney, Agent, or Firm*—Ernest F. Marmorek

[57] ABSTRACT

In a press operable for movements of proof plate exchangeably mounted on an end of a press die into and out of a mold, and wherein the proof plate normally does not exceed a position wherein its topmost portion is at most flush with a topmost portion of the mold during the movements, the improvement includes a drive device independent of the movements for moving the proof plate beyond the topmost portion of the mold, so that the proof plate projects through the mold, and is thereby freely accessible for the purpose of being replaced.

9 Claims, 4 Drawing Figures

PRESS WITH EASILY EXCHANGEABLE PROOF PLATES

CROSS REFERENCE TO RELATED APPLICATIONS

Reference is made to co-pending application Ser. No. 69,547, filed Aug. 24, 1979, for "Method and Apparatus for Manufacturing Hollow Bodies" assigned to the assignee of the present invention, and now abandoned, based on the prior application No. DE-P 27 37 878.1 filed in the Federal Republic of Germany on Aug. 30, 1978.

BACKGROUND OF THE INVENTION

Presses, particularly presses for the fabrication of fire resistant bricks, use press dies having at the end thereof a proof plate, which needs to be frequently replaced. The need to frequently replace the proof plates is due, on the one hand, to the different shapes and sizes of the bricks to be fabricated, and on the other hand, due to the wear and tear of the proof plates during the manufacture of bricks. Replacement of the proof plates, if either the shape and/or size of the bricks is to be changed, or if the proof plate has been unduly worn, is very time-consuming and awkward in known presses, and further requires that the press be out of operation during the replacement of the proof plates, which leads to additional nonproductive costs. Apart from the time-consuming work, security precautions which must be taken when operating the press are increased, as an operator who replaced the proof plates must conduct the work in surroundings contaiminated by wastes, such as ceramic sand, usually found below the mold table.

SUMMARY OF THE INVENTION

It is therefore one of the principal objects of the present invention to devise a press of the aforesaid type by avoiding the previously cited disadvantages, so that the proof plates may be easily accessible and quickly replaced.

Further objects and advantages of the invention will be set forth in part in the following Specification, and in part will be obvious therefrom without being specifically referred to, the same being realized and attained as pointed out in the claims hereof.

BRIEF DESCRIPTION OF THE DRAWING

For a fuller understanding of the nature and objects of the present invention, reference should be had to the following detailed description, taken in connection with accompanying drawings in which.

DESCRIPTION OF THE PREFERRED EMBODIMENTS

Figure 1:
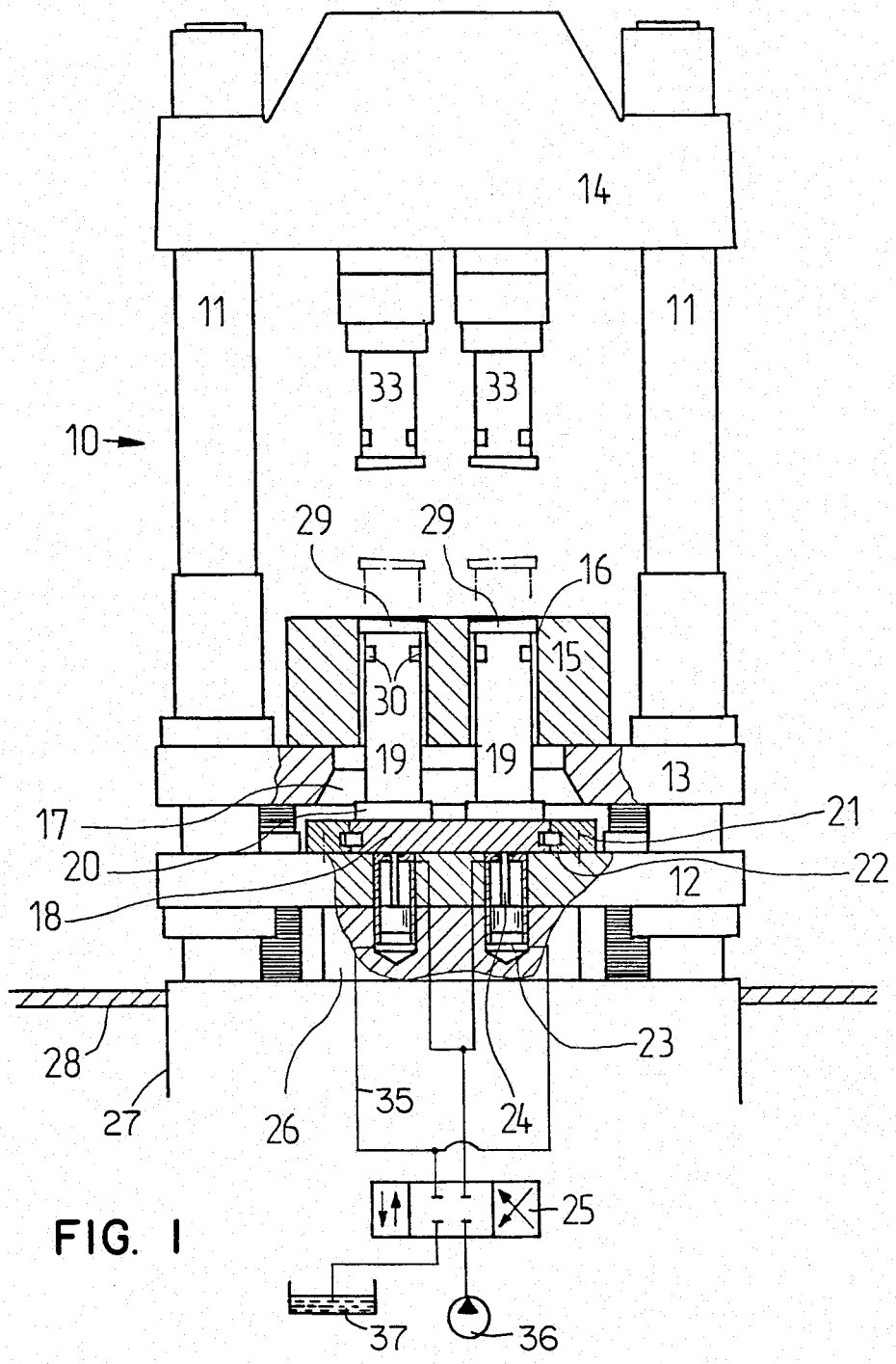
FIG. 1 is a side-view of the press including supporting means for the press die.

In carrying the invention into effect, and referring now particularly to FIG. 1, there will be seen a hydraulically operated press 10, including guide column means in the form of four vertically disposed columns 11. The press 10 includes press die means in the form of two press dies 19, constituting a first portion of the press die means, and a hydraulically-operated press plate 12 displaceable along the columns 11, constituting a second portion of the press die means, the stationary press dies 33 shown in the upper portion of the press 10 constituting a third portion of the press die means.

Above the press plate 12 there is disposed a mold table 13, which is also displaceable along the column 11, and which is driven hydraulically. A yoke 14 is disposed on the upper ends of the columns 11, which hold the columns 11 together, the yoke being secured by corresponding nuts.

On the mold table 13 there is disposed a mold 15, which has upper and lower faces, and defines throughgoing bores 16. An aperture 17 is defined in the mold table 13, which communicates with the bores 16 in the mold 15, and is of a cross-sectional area exceeding the cross-sectional area of the bores 16. On the press table 12 there are disposed supporting means, such as a supporting device 18, which in turn acts as a support for two press dies 19, end flanges 20 situated at the lower respective end of the press dies 19 being secured by means of (non-illustrated) screws to the supporting device 18.

The supporting device 18 is provided with releasable locking means, which is constituted by two bars 21 disposed on each side of the supporting device 18, and secured, for example, by screws to the press plate 12. It will be noted that the supporting device 18 is formed with two recesses on opposite sides thereof, and that the bars 21 are formed with corresponding recesses juxtaposed with the respective recesses of the supporting device 18. The locking means further includes wedges 22 which may therefore be inserted into the pair of juxtaposed recesses respectively, in which position the supporting device 18 is releasably secured to the press plate 12 by the wedges 22.

Within the press plate 12 there are disposed drive means in the form of dual hydraulically driven piston and cylinder arrangements 23, each cylinder and piston arrangement 23 having a piston rod 24 connected to the supporting device 18. The hydraulic piston and cylinder mechanism 23 is driven with its associated piston rod through fluid-carrying tubes 35 by means of a fluid switch 25, described in detail in the aforesaid co-pending application Ser. No. 69,547, now abandoned based on German priority application No. DE-P 28 37 878.1 the fluid switch 25 being in turn actuated by a pump 36, any excess fluid is allowed to pass into a fluid reservoir 37. The piston may be driven upwardly only in the direction of motion of the press die 19 into the bore 16 of the mold 15, in which case the supporting device 18 is movable downwardly by gravity. Alternately, the piston and cylinder mechanism 23 may be driven in opposite directions during both a press stroke and a release stroke, respectively.

The press plate 12 itself is driven by a central piston 26. The hydraulic drive means for the central piston 26 is disposed within a cover 27, the cover 27 being normally disposed in a floor 28.

Figure 2:
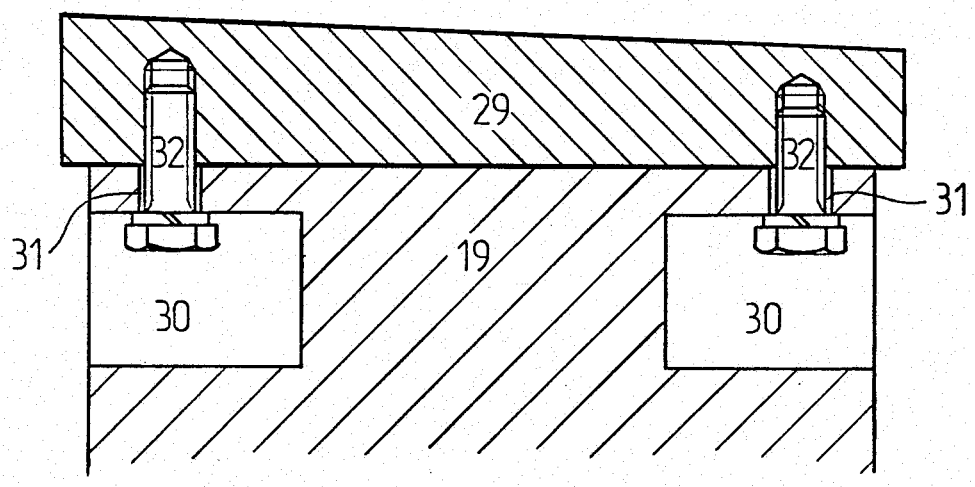
FIG. 2 is a longitudinal section along the line II—II of the press die and an associated proof plate, FIG. 3 corresponds to FIG. 1, but shows a version of the present invention where the piston is drivable upwardly only, and the supporting means are movable downwardly by gravity.
Figure 3:
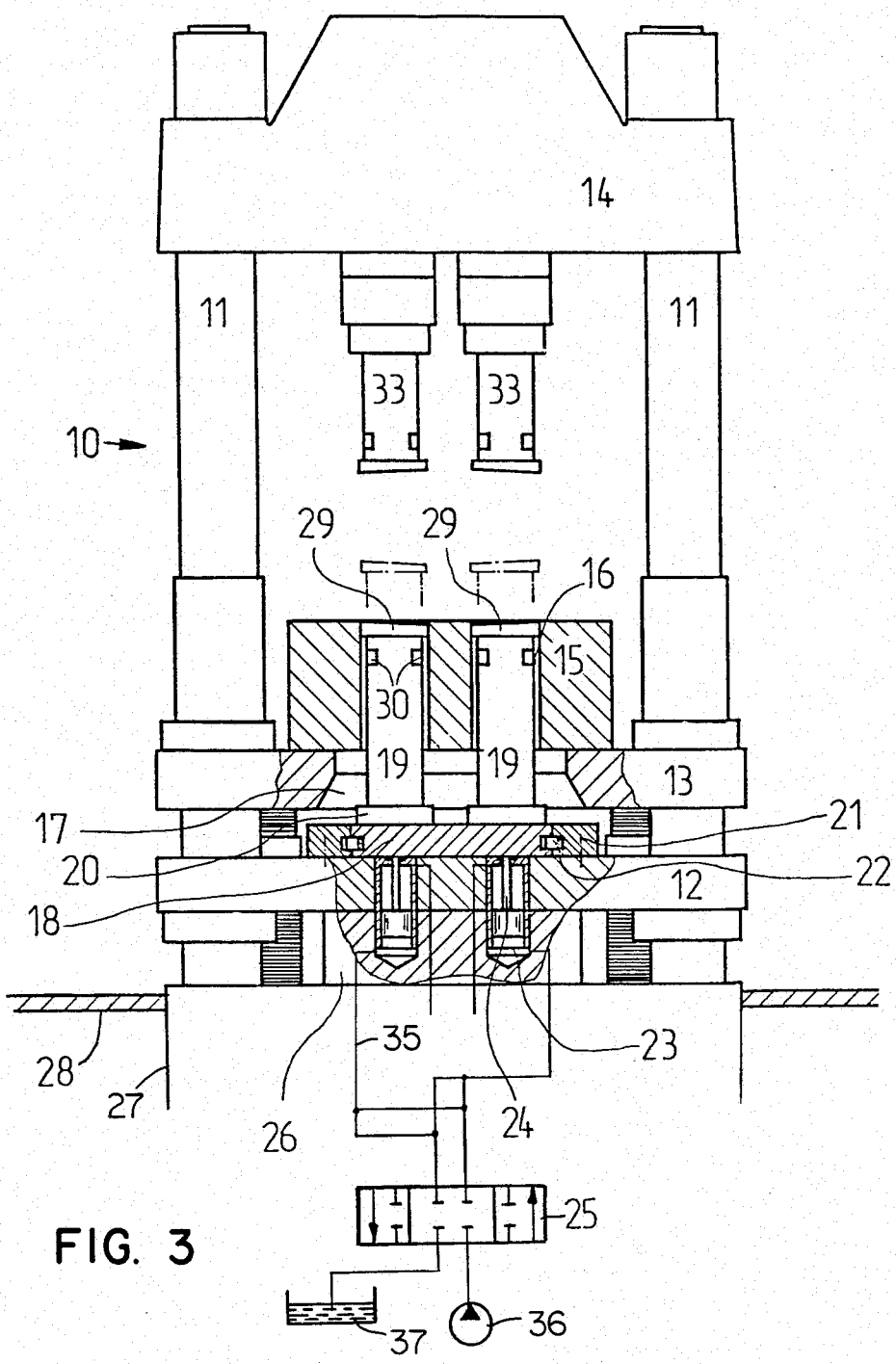
Figure 4:
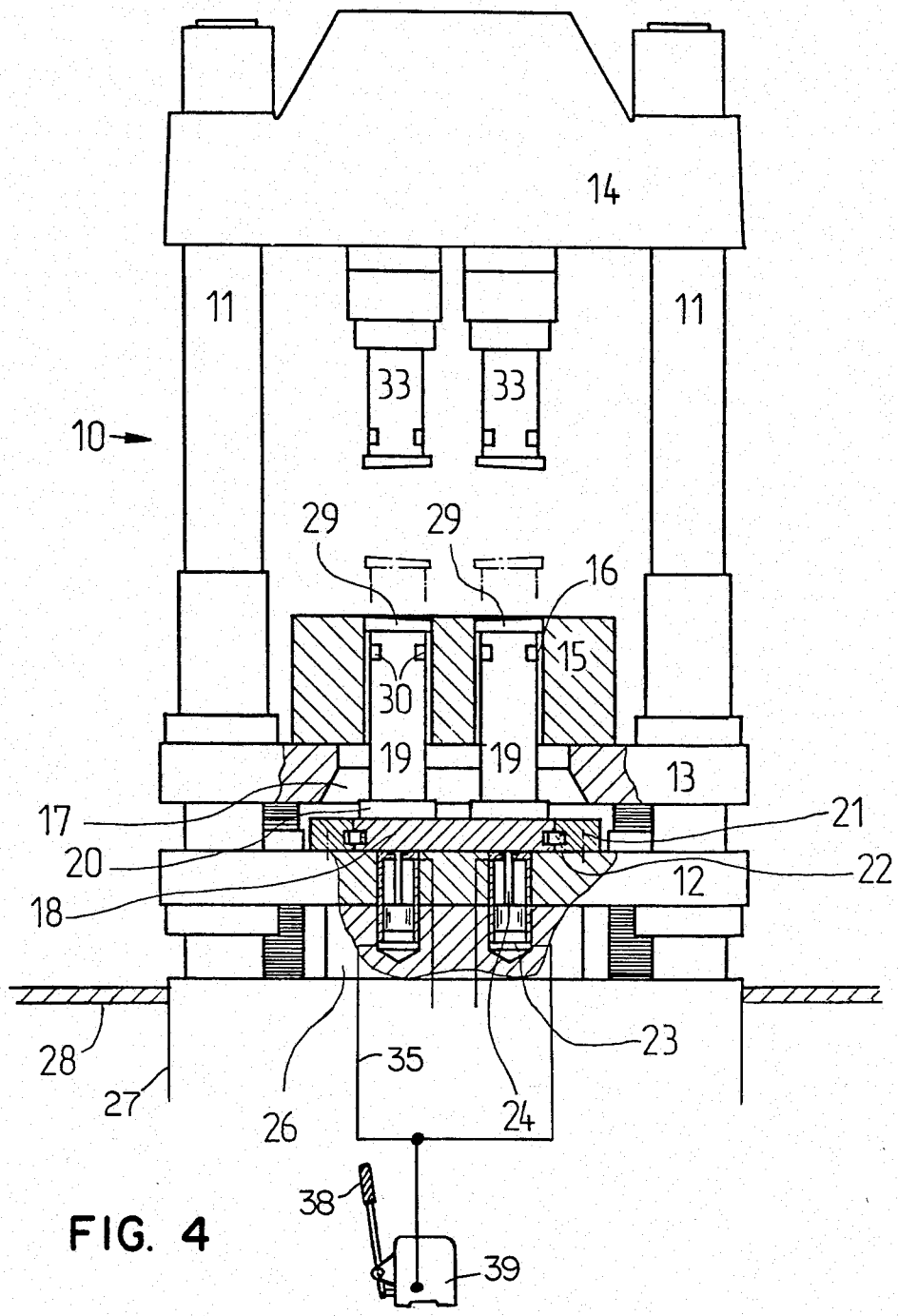
FIG. 4 shows an example of a muscularly energizable drive means.

The press dies are provided at the upper ends with exchangeable proof plates 29, respectively. As is shown in detail in FIG. 2, the proof plates 29 are formed with non-throughgoing internal threads. On the periphery of each press die 19 there are formed near the upper end of the press die 19 recesses 30, which in turn communicate with bores 31 alignable with the internal threads in the proof plate 29, so that the proof plate 29 can be secured to the press die 19 by means of screws 32.

Above the press dies 19 and disposed opposite them at a predetermined distance, there are disposed stationary press dies 33, which are secured to the yoke 14. The press dies 33, similar to the press dies 19, are also provided with corresponding proof plates. During the pressing operation, namely during the press stroke and release stroke of the press plate 13, the support device 18 is releasably secured to the press plate 12 by the wedges 22 being inserted into the juxtaposed recesses of the supporting device 18 and the bars 21, so that any unintentional vertical movement of the press dies 19 is avoided. Prior to the press stroke, the press plate 12, and the mold table 13 are disposed at a distance from one another, so that the proof plates 29 are disposed at a lower end of the bores 16, thus effectively forming a floor for the mold 15 in its lower region.

Following the press stroke, the mold table 13 assumes a position in FIG. 1, wherein the proof plates 29 of the press dies 19 are substantially flush with the upper face of the mold 15, so that the pressed material is expelled from the mold 15. It will therefore be seen that during pressing operations the proof plate 29 is normally restrained from exceeding a position wherein its top portion is at most flush with the topmost portion of the mold 15. If it is desired to replace the proof plate 29 of the press dies 19, the wedges 22 are removed, and the supporting device 18 supporting in turn the press dies 19, is driven by the hydraulic cylinder and piston mechanism 23, and is lifted off the press plate 12, so that the upper ends of the press dies 19 project through the bores 16, the ends of the press dies 19 provided with a proof plate 29 thus being freely accessible, as they project upwardly beyond the top face of the mold 15. In this position, which is shown in broken lines in FIG. 1, the proof plates 29 are now easily accessible, and may be replaced. Following replacement of the proof plates 29, the supporting device 18 is either allowed to move downwardly by gravity, or is driven in a downward direction by the cylinder and piston mechanism 23 through the fluid switch 25 to a position, where pressing operations can be resumed. The wedges 22 must, of course, be again inserted into the previously described juxtaposed recesses, so that the press plate 12 is again secured to the supporting device 18.

It will be appreciated that although a fluid-operated drive means, including the fluid switch 25 have been illustrated, it is equally possible to provide a motor, particularly an electric motor, in lieu of the hydraulically operated switch 25. Alternatively, the drive means may be muscularly energized means, such as a hand pump 38 for driving fluid through a fluid container 39 and fluid carrying tubes 35 to the piston and cylinder mechanism 23, a crank drive, a rack-and-piston drive or a gear drive.

Having thus described the invention, what I claim as new and desire to be secured by Letters Patent is as follows:

1. A press, comprising in combination:

press die means actuatable at least in part for movement in opposite directions, a mold movable in said opposite directions defining at least one through-going bore and being adapted to be filled on its interior with granular material, a mold table for mounting said mold on a face of said mold table and defining a through-going aperture having a cross-sectional area exceeding the cross-sectional area of said bore, a first portion of said press die means being insertable into said bore through said aperture, a proof plate exchangeably mounted on an end of said first portion of said press die means, and operable to be introduced into said bore, said press die means including a second portion for moving said first portion into said bore in a press stroke, and subsequently returning said first portion in a release stroke, said proof plate being normally restrained from exceeding a position wherein its topmost portion is at most flush with a topmost portion of said mold during said strokes, supporting means releasably secured during both opposite strokes to said second portion, for supporting said first portion, and drive means independent of said strokes and operable for lifting said supporting-means off said second portion in the direction of motion of said first portion into said bore, upon said second portion being released from said supporting means, so that said first portion projects through said bore, and said proof plate projects through said mold, and is thereby freely accessible for the purpose of being replaced.

2. A press as claimed in claim 1 further comprising guide column means, said mold table being reciprocally displaceable on said guide column means, and wherein said first portion of said press die means includes a press die, and said second portion of said press die means includes a press plate.

3. A press according to claim 1, wherein said drive means is a fluid-operated drive means.

4. A press according to claim 3, wherein said fluid-operated drive means includes at least one vertical piston and cylinder mechanism, the piston being drivable upwardly only in the direction of motion of said first portion of said press die means into said aperture and into said bore, said supporting means being movable downwardly by gravity.

5. A press according to claim 3, wherein said fluid-operated drive means includes at least one piston and cylinder mechanism, the piston being drivable in opposite directions during the pressing and release strokes, respectively.

6. A press according to claim 3, wherein said supporting means includes releasable locking means, said supporting means being rigidly locked by said locking means to said second portion of said press die means during both opposite strokes.

7. A press according to claim 1, wherein said mold has two opposite sides and defines a second through-going bore, said bores being substantially equidistant from each of said sides.

8. A press according to claim 1, wherein said drive means is a muscularly energized drive means.

9. A press according to claim 8, wherein said drive means is a handpump.

* * * * *